US008974638B2

(12) United States Patent
Knopp et al.

(10) Patent No.: US 8,974,638 B2
(45) Date of Patent: Mar. 10, 2015

(54) DEVICE FOR RETAINING DOCTOR BLADES

(75) Inventors: Joachim Knopp, Hückeswagen (DE); Axel Borgmann, Hückeswagen (DE)

(73) Assignee: Joh. Clouth GmbH & Co. KG, Hückeswagen (DE)

( * ) Notice: Subject to any disclaimer, the term of this patent is extended or adjusted under 35 U.S.C. 154(b) by 0 days.

(21) Appl. No.: 14/240,992

(22) PCT Filed: Aug. 14, 2012

(86) PCT No.: PCT/EP2012/065875
§ 371 (c)(1),
(2), (4) Date: Feb. 25, 2014

(87) PCT Pub. No.: WO2013/029989
PCT Pub. Date: Mar. 7, 2013

(65) Prior Publication Data

US 2014/0196860 A1 Jul. 17, 2014

(30) Foreign Application Priority Data

Aug. 31, 2011 (DE) ..... 10 2011 081 927

(51) Int. Cl.
*B31F 1/12* (2006.01)

(52) U.S. Cl.
USPC ..... 162/280

(58) Field of Classification Search
USPC ..... 162/280, 281, 272, 199, 263
See application file for complete search history.

(56) References Cited

U.S. PATENT DOCUMENTS

| | | | | |
|---|---|---|---|---|
| 6,202,252 | B1 * | 3/2001 | Harrisson | 15/256.51 |
| 6,458,247 | B1 * | 10/2002 | Uuttana | 162/281 |
| 7,108,766 | B1 * | 9/2006 | Eskelinen et al. | 162/263 |
| 2005/0223513 | A1 * | 10/2005 | Mau et al. | 15/256.51 |
| 2006/0054293 | A1 | 3/2006 | Strauch | |
| 2007/0187057 | A1 * | 8/2007 | Bartelmuss et al. | 162/281 |
| 2008/0121770 | A1 | 5/2008 | Bartelmuss et al. | |
| 2009/0148208 | A1 * | 6/2009 | Gauvin et al. | 399/351 |
| 2010/0186770 | A1 * | 7/2010 | Johnson et al. | 134/6 |
| 2010/0200187 | A1 * | 8/2010 | Johnson et al. | 162/199 |
| 2010/0218909 | A1 * | 9/2010 | Gauvin et al. | 162/199 |

FOREIGN PATENT DOCUMENTS

| | | | |
|---|---|---|---|
| AT | 503 922 | A4 | 2/2008 |
| EP | 1 567 715 | B1 | 5/2006 |
| EP | 1 734 181 | A1 | 12/2006 |
| EP | 2 141 284 | A2 | 1/2010 |
| WO | WO 2004/042143 | A1 | 5/2004 |
| WO | WO 2009/076128 | A1 | 6/2009 |

OTHER PUBLICATIONS

International Search Report issued by the European Patent Office in International Application PCT/EP2012/065875 on Sep. 25, 2012.

* cited by examiner

*Primary Examiner* — Mark Halpern
(74) *Attorney, Agent, or Firm* — Henry M. Feiereisen LLC

(57) ABSTRACT

A device for retaining doctor blades a bottom plate and a top plate, said plates being pivotally connected together by means of a pivot bearing and the doctor blade is fixed to the top plate. An expandable tube is arranged respectively on both sides of the pivot bearing between the bottom plate and the top plate, said pivot bearing consisting of a radially supported bearing shaft and a receiving element for the bearing shaft. The bearing shaft is fixed either to the bottom plate or the top plate and the receiving element is fixed to either the top plate or the bottom plate.

8 Claims, 2 Drawing Sheets

DEVICE FOR RETAINING DOCTOR BLADES

CROSS-REFERENCES TO RELATED APPLICATIONS

This application is the U.S. National Stage of International Application No. PCT/EP2012/065875, filed Aug. 14, 2012, which designated the United States and has been published as International Publication No. WO 2013/029989 and which claims the priority of German Patent Application, Serial No. 10 2011 081 927.4, filed Aug. 31, 2011, pursuant to 35 U.S.C. 119(a)-(d).

BACKGROUND OF THE INVENTION

The invention relates to a device for retaining doctor blades with a bottom plate and a top plate, wherein the bottom plate and the top plate are hingedly connected to each other via a pivot bearing and the doctor blade is affixed to the top plate, wherein an expandable tube is provided between the bottom plate and the top plate on each side of the pivot bearing.

A scraping device or doctor blade has the task, among others, to clean the surface of a roller or a cylinder. In the case of a paper machine, such a doctor blade has the effect that the paper web guided across the respective roller of the paper machine is not wound up on the roller in the event of a web break, but exits the roller at the predetermined position to reach, for example, a collection tray. This doctor blade must ensure that this task is performed with 100% certainty, since otherwise considerable failures would occur in the papermaking process, possibly even damage the paper machine. The doctor blade also has the task to clean the surface of the roller so that the paper web is not marked. For this reason, the doctor blade attached to its retaining device must be in contact with the roller as uniformly as possible over its entire length. For pressing the doctor blade onto the roller surface, the retaining device is generally constructed in two parts and has a bottom plate which is typically attached on the machine frame. A top plate is pivotally attached on this bottom plate, so that the doctor blade can be lifted off the roller surface, or placed on and pressed against the roller surface (EP 1567715 B1).

It has been shown that, especially in the wet parts of the paper machine relatively strongly contaminate the retaining devices, requiring frequent cleaning. For this purpose, the top plate must be removed from the bottom plate so that the retaining device can be opened. WO 2004/042 143 A1 discloses a doctor blade retaining device wherein the bottom plate has a bearing tube and the top plate is pivotally mounted around the bearing tube. To open this retaining device, the top plate is withdrawn in the axial direction from the bearing tube, thereby allowing access to the interior space. With rollers that can have a length of 12 m the retaining device for the doctor blade must also have this length, and it has been found that with such a length, the frictional forces along the bearing tube are relatively large, so that the top plate can be withdrawn or pushed on only with difficulty.

WO 2009/076 128 A1 also discloses a retaining device for doctor blades. However, this retaining device is complicated to manufacture since it is made of a continuous casting part, which has to be machined even further. This retaining device also tends to be heavily contaminated. AT 503 922 A4 also shows such retaining device.

SUMMARY OF THE INVENTION

Starting from EP 1567715 B1, it is an object of the invention to provide a device for retaining doctor blades which can be more easily installed and cleaned and which is also well protected against contamination.

This object is attained with a device for retaining a doctor blade, with a bottom plate and a top plate pivotally connected to the bottom plate via a pivot bearing, with the doctor blade being attached to the to plate. The top plate includes a deflection plate pointing toward the bottom plate at a clamping location for the doctor blade. An expandable pressure hose is disposed between the bottom plate and the top plate on each side of the pivot bearing. A radially supported bearing shaft is attached to or formed on either the bottom plate or the top plate, whereas a receptacle for the bearing shaft attached to or formed on either the top plate or the bottom plate, with the bearing shaft and the receptacle forming the pivot bearing. A piping guide chamber is disposed on a side of the top plate facing the doctor blade, and a flexible seal is attached on a side of the bottom plate facing the piping guide chamber and having a free end with piping engaging in the piping guide chamber. The flexible seal and the deflection plate seal a gap formed between the bottom plate and the top plate, wherein the gap extends in a longitudinal direction of the device.

By constructing the pivot bearing with a radially supported bearing shaft on the bottom plate or on the top plate and a receptacle for the bearing axis on the top plate or the bottom plate, it is ensured that the bearing shaft remains on one component and the receptacle on the other component when the device is disassembled. This measure has the significant advantage that no extra components are generated during disassembly and no additional components are required during installation. For example, no loose shaft needs to be inserted in receiving eyes on the bottom plate and the top plate after these receiving eyes were brought into alignment. Such operation typically requires a number of tools, such as a retaining device for the top plate, an alignment device for aligning the top plate and bottom plate, and typically several persons monitoring joining of the components. With the device according to the invention, the bearing shaft only needs to be threaded into the receptacle for subsequent complete insertion together with the top plate, without requiring additional tools. The top plate and the bottom plate are then pivotally connected to one another.

According to the invention, the top plate has a piping guide chamber located in particular on the opposite side (backside) of the doctor blade. In addition, a flexible seal is fastened on the bottom plate on the side facing the piping guide chamber, with the free end of the flexible seal having a piping engaging with and supported by the piping guide chamber. The seal is formed by a fluid-tight material, such as a rubberized fabric web or another material. One end of this seal extending in the longitudinal direction is affixed on the bottom plate, while the piping disposed on other end is secured in the piping guide chamber of the top plate. The piping can thus be inserted into its piping guide chamber at the same time the bearing shaft is inserted.

Furthermore, according to the invention, the top plate may have a deflector plate disposed at the clamping point for the doctor blade and pointing in the direction of the bottom plate, which serves to keep liquids with which the roller is wetted, or dirt away from the interior space. The deflector plate closes or covers the gap facing the roller between the bottom plate and the top plate.

In an exemplary embodiment, the bottom plate is formed in the shape of a trough with two side walls. This is used to accommodate additional components, e.g. the pressure hoses for pivoting the top plate and thus for selectively pressing and lifting of the doctor blade. In addition, electric cables or other hydraulic or pneumatic supply lines may be installed in the bottom plate.

In a preferred exemplary embodiment, the bottom plate has a substantially W-shaped cross-section. The outer legs form hereby the lateral walls and to protect the interior space of the bottom plate.

In a variant of the device that is on the one hand stable and on the other hand inexpensive, the bottom plate is formed by a bent sheet metal profile, in which the bearing axis is integrated by forming. This bottom plate is torsionally stiff and is fast and inexpensive to produce. Since the bottom plate is made as one piece, the interior space is protected without additional measures from below and from the side by way of the side walls against both mechanical effects and intruding media.

Preferably, the bearing shaft is formed in substantially Ω-shaped, so that it can also serve as a bearing for a tube which is inserted into the round and hollow opening and then clamped or welded. The tube has a thread and is used for attaching the top plate.

In an advantageous embodiment of the invention, the receptacle is shaped as a C that is open in the direction of the bottom plate. The pivot angle is defined by the opening angle of the receptacle, and may optionally be adjusted by lateral supports in the web of the bearing shaft.

Trouble-free insertion of the bearing shaft and therefore an easy assembly of the bottom plate and top plate are achieved in that the receptacle extends over the entire length of the top plate or along sections over its length. When the receptacle extends along sections, then the bearing axis needs only be inserted in the first two or three sections of the receptacle, whereafter it is guided by the sections so as to engage in the following sections without requiring tools. This allows a simple cross-exchange.

Further advantages, features and details of the invention are evident from the dependent claims and from the following description in which a preferred embodiment is described. The features shown in the drawing and mentioned in the description and in the claims may be essential for the invention severally or in any combination.

DETAILED DESCRIPTION OF PREFERRED EMBODIMENTS

Figure 1:
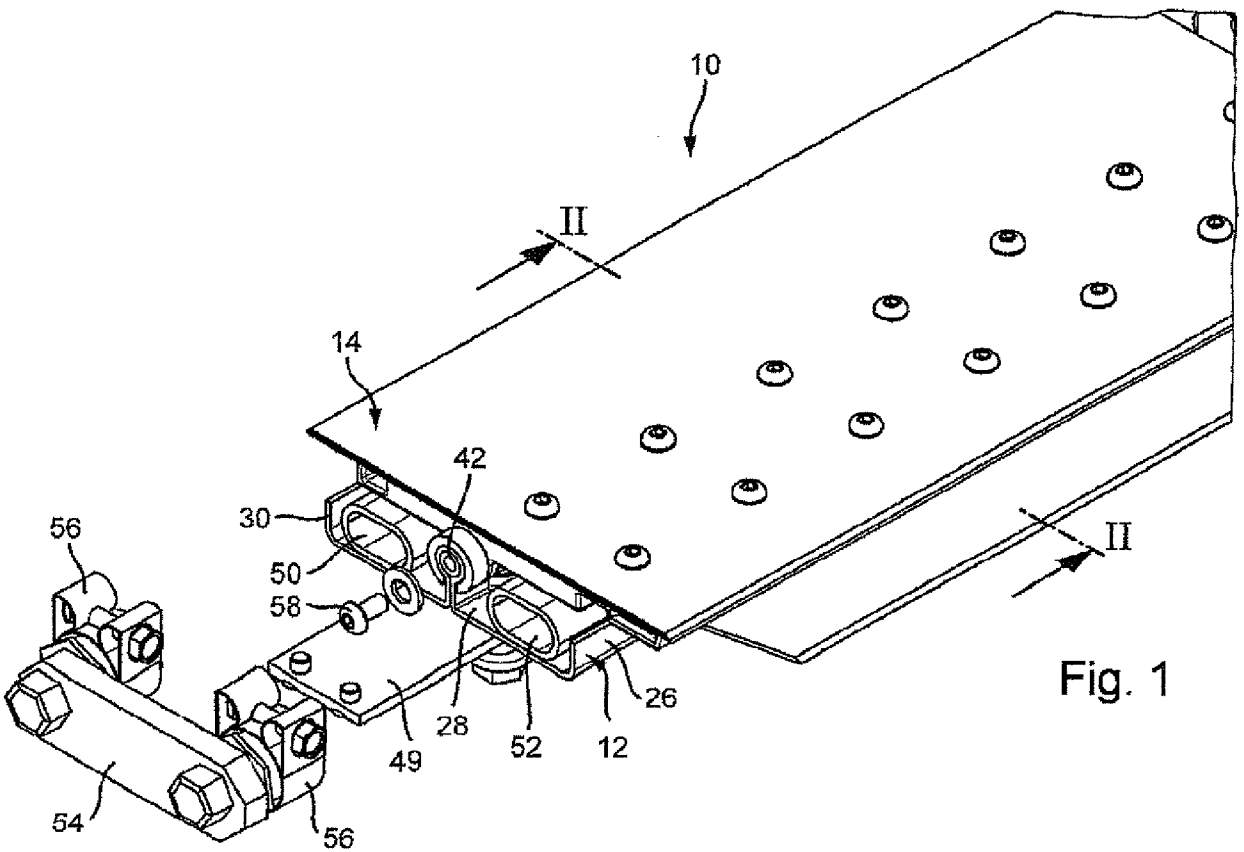
FIG. 1 shows a perspective view of the retaining device according to the invention.
Figure 2:
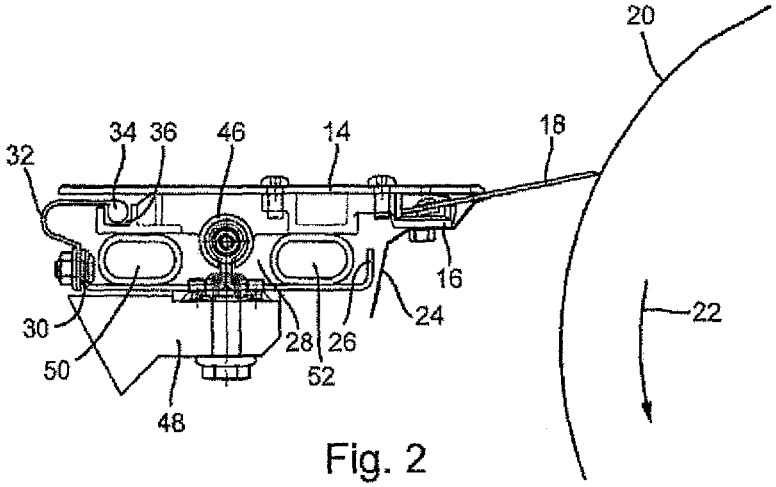
FIG. 2 shows a section II-II according to FIG. 1.

FIG. 1 shows a retaining device generally designated with 10, with a bottom plate 12 and a top plate 14. Retaining fingers 16 (FIG. 2) with which a doctor blade 18 is held and pressed against the surface 20 of a roller 22 are provided on the top plate 14. A deflection plate 24 is mounted on the front side of the top plate 14 facing the roller 20, with the deflection plate 24 overlapping with and shielding the front side wall 26 of the bottom plate 12, thereby preventing dirt or liquid from entering the intermediate space 28 between the bottom plate 12 and the top plate 14. A flexible flat seal 32 is screwed onto the side wall 30 of the bottom plate 12 forming the backside, with the free end of the seal 32 having a piping 34 which is inserted into a piping guide chamber 36 disposed on the top plate 14. In this way, the intermediate space 28 is sealed or at least shielded.

Figure 4:
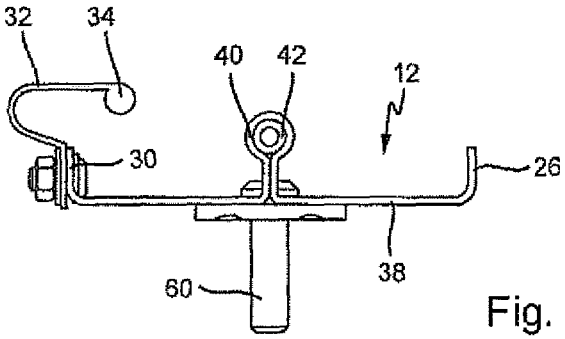
FIG. 4 shows the bottom plate in cross-section.

As is also evident from FIG. 4, the bottom plate 12 is formed from a bent sheet metal profile 38 and is essentially Ω-shaped at its center. Thus, a bearing shaft 40 is formed, in which a tube 42 can be inserted to attach the top plate 14 which can be secured for example by welding.

Figure 3:
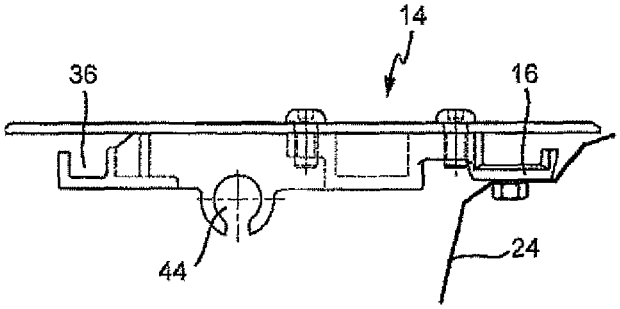
FIG. 3 shows the top plate in cross-section.

FIG. 3 shows the top plate 14, which has a receptacle 44 that is slotted at its bottom in its central region in the direction of the bottom plate 12 and serves to receive the bearing shaft 40. The receptacle 44 and the bearing shaft 40 form a pivot bearing 46 for the top plate 14, and thus for the doctor blade 18. Here, the receptacle 44 extends either over the entire length of the top plate 14 or is divided into sections with intermediate free spaces.

Two pressure hoses 50 and 52 are disposed in the intermediate space 28 on either side of the pivot bearing 46 for pivoting the top plate 14 relative to an only schematically indicated frame or an adapter strip 49. A flange 54 with hose clamps 56 is provided for lateral closure of the intermediate space 28 and for connecting the two pressure hoses 50 and 52 to pneumatic or hydraulic lines. The top plate 14 is secured to the bottom plate 12 via a retaining screw 58 which is screwed into end faces of the pipe 42 on both sides of the pivot bearing 46.

The bearing shaft 40 may be continuous, but may also be divided into sections so as to leave spaces between the sections where bolts or screws 60 can be inserted in the bottom plate 12, via which the bottom plate 12 is affixed to the holder 48.

The invention claimed is:

1. A device for retaining a doctor blade, the device comprising:

a bottom plate, a top plate pivotally connected to the bottom plate via a pivot bearing, with the doctor blade being attached to a front end of the top plate, the top plate comprising a deflection plate attached to the front end pointing toward the bottom plate at a clamping location for the doctor blade and sealing a gap formed between the bottom plate and the top plate, said gap extending at the front end in a longitudinal direction of the device, an expandable pressure hose disposed between the bottom plate and the top plate on each side of the pivot bearing, a radially supported bearing shaft attached to or formed on either the bottom plate or the top plate, a receptacle for the bearing shaft attached to or formed on either the top plate or the bottom plate, with the bearing shaft and the receptacle forming the pivot bearing, a piping guide chamber disposed at a rear end of the top plate on a side of the top plate facing the doctor blade, a flexible seal attached at a rear end of the bottom plate facing away from the doctor blade and on a side of the bottom plate facing the piping guide chamber and having a free end comprising a piping engaging in the piping guide chamber, wherein the flexible seal seals a gap formed between the bottom plate and the top plate at the respective rear ends of the top plate and the bottom plate.

2. The device of claim 1, wherein the bottom plate is shaped as a trough with two side walls.

3. The device of claim 1, wherein the bottom plate has a substantially W-shaped cross-section.

4. The device of claim 1, wherein the bottom plate is formed by a bent sheet metal profile, into which the bearing shaft is integrated by forming.

5. The device of claim 1, wherein the bearing shaft is substantially Ω-shaped.

6. The device of claim 5, wherein the bearing shaft is reinforced by a tube or a rod.

7. The device of claim 1, wherein the receptacle is C-shaped and is open toward the bottom plate.

8. The device of claim 1, wherein the receptacle extends along an entire length of the top plate or along sections of the length of the top plate.

* * * * *